United States Patent [19]

Haven

[11] 4,139,103

[45] Feb. 13, 1979

[54] MINE CAR COUPLING INCLUDING SAFETY MECHANISM

[76] Inventor: Robert M. Haven, 204 E. Emma, Lafayette, Colo. 80026

[21] Appl. No.: 874,330

[22] Filed: Feb. 1, 1978

[51] Int. Cl.[2] ..... B61G 1/00

[52] U.S. Cl. ..... 213/75 B; 213/159; 213/188; 213/210

[58] Field of Search ..... 213/188, 189, 200, 209, 213/210, 179, 178, 218, 211, 159, 190, 198, 191, 75 R, 75 B, 163–164

[56] References Cited

U.S. PATENT DOCUMENTS

| | | | |
|---|---|---|---|
| 2,389,821 | 11/1945 | Shealy | 213/188 |
| 2,391,610 | 12/1945 | Altimus | 213/188 |
| 4,043,457 | 8/1977 | Miller et al. | 213/75 B |

*Primary Examiner*—Galen L. Barefoot
*Assistant Examiner*—Douglas C. Butler
*Attorney, Agent, or Firm*—Lane, Aitken & Ziems

[57] ABSTRACT

A safety mechanism for a mine car coupling which includes a draw pin, a pin guide connected to a first mine car with an essentially vertical opening therein for receiving the draw pin, a space beneath the pin guide for receiving a link connected to a second mine car, the link having an opening therein for receiving the draw pin. The draw pin includes an upper shoulder which will engage an upper surface of the pin guide and hold the draw pin in its lower position for insertion through the link opening to couple the cars together. The safety mechanism includes a first interposer pivotally connected to the first car at a point below the upper shoulder of the draw pin and projecting above the upper shoulder a predetermined, distance when the pin is in its lower position. There is a device for urging the first interposer toward the upper shoulder so that when the draw pin is in its lower position the first interposer will engage an outer surface of the upper shoulder, and when the draw pin is raised the first interposer will engage an undersurface of the shoulder for preventing the pin from moving toward its lowered position. A second interposer is connected to the first mine car and movable between inner and outer positions and there is a device for urging the second interposer toward the outer position. The second interposer includes a first arm positioned to engage the link connected to the second mine car when the link is in position to receive the draw pin for retaining the second interposer in the inner position, the second interposer being moved toward the outer position by an urging device when the link disengages from the first arm.

9 Claims, 5 Drawing Figures

MINE CAR COUPLING INCLUDING SAFETY MECHANISM

BACKGROUND OF THE INVENTION

This invention relates to mine car couplings and, in particular, to a coupling which satisfies mine safety requirements by safely retaining a draw pin in an upper non-engaging position when adjacent mine cars are being separated and which will automatically couple the cars when they are brought together.

Most conventional mine car couplings utilize a draw pin which is insertible through a draw bar connected to one end of a mine car. A space is provided between the draw bar and a lower deck into which a link connected to the other car can be inserted, the link including an opening so that once the link is in place the draw pin can be pushed downwardly through the opening to couple the cars together.

With the advent of more stringent mine safety regulations such couplings must now have the capability of retaining the draw pin safely in its upper non-coupling position while the cars are uncoupled.

SUMMARY OF THE INVENTION

The safety requirements mentioned above are satisifed by the mine car coupling described and shown herein. The coupling mechanism utilizes a draw pin which is mounted on one car and cooperates with a connecting link mounted on the other car. When the cars are coupled the draw pin is inserted through an opening in the link and locked in place by a linkage having two members connected at a pivot point which provide a gravity held overcenter locking mechanism connected to the top of the pin. Draw handles mounted on the front of the mine car are connected to the upper linkage member so the pin can be manually lifted.

The coupling mechanism includes a first interposer which is pivotally mounted on the member which holds the draw pin and which is movable into and out of the path of a shoulder on the upper end of the draw pin. The first interposer includes a counterweight which urges the interposer toward the draw pin so that the interposer will automatically pivot and move under the shoulder when the draw pin is raised.

A second interposer is rotatably mounted on the front of the mine car and includes an upper arm which is also movable into and out of the path of the draw pin shoulder. The second interposer also includes a contact face which cooperates with the counterweight of the interposer and a lower arm which is positioned to be contacted by the connecting link of the other mine car when the cars are brought together. A spring is provided normally to urge the upper arm of the second interposer away from the mine car and toward the draw pin.

When a draw handle is used to raise the draw pin and the shoulder is higher than the upper end of the first interposer, the counterweight will cause the interposer to move under the shoulder and hold the draw pin in the raised position. As the mine cars move apart the connecting link will withdraw from the position where it engages the lower arm of the second interposer, causing the spring to urge the upper arm of the second interposer into its position beneath the shoulder of the link pin. At the same time the contact face of the interposer will push the counterweight and raise the upper end of the first interposer to move out of contact with the shoulder so that the draw pin will drop a short distance to cause the shoulder to engage the upper arm of the second interposer.

Coupling of the mine car is accomplished automatically by moving the cars together so that the connecting link will be inserted back to its original position and engage the lower arm of the second interposer. In this way the lower arm will be moved toward the front of the mine car on which it is connected, which causes the upper arm of the second interposer to move out of contact with the shoulder of the draw pin and allow the link pin automatically to drop in place and couple the cars together.

These objects and other features and advantages of the invention will become apparent by reference to the detailed description provided below taken in conjunction with the accompanying drawings.

DETAILED DESCRIPTION OF A PREFERRED EMBODIMENT

Figure 1:
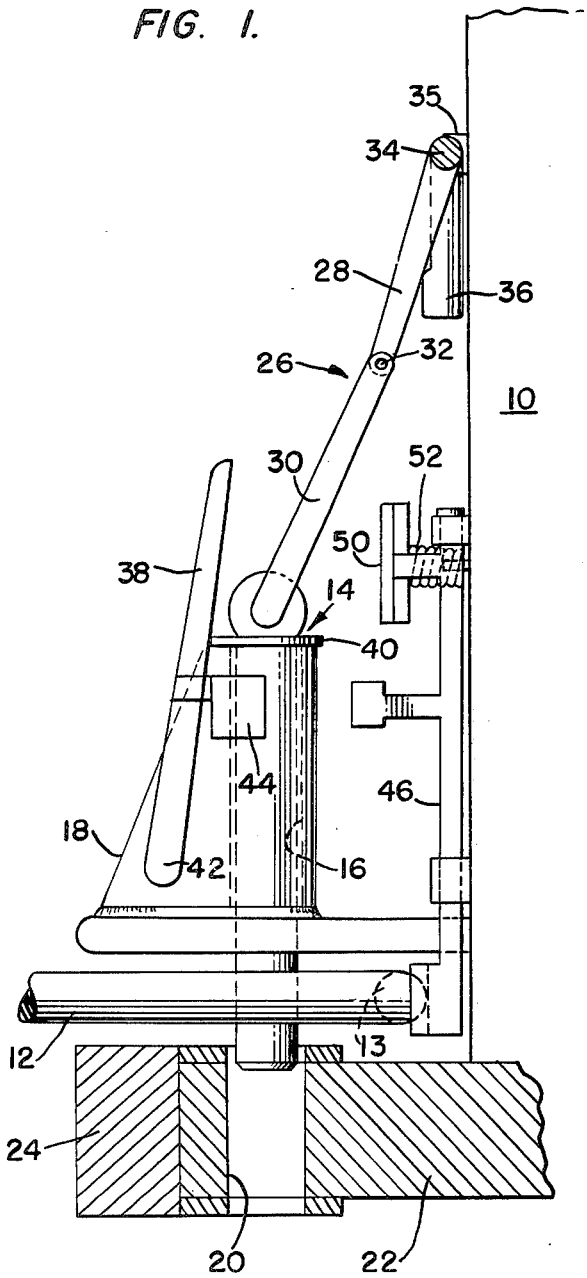
FIG. 1 is a side plan view which is partially in section showing the mine car coupling when two mine cars are coupled together.

Referring to FIG. 1, a first mine car 10 is coupled to a second mine car (not shown) through a link 12 which is connected to the second car and includes an opening 13. The coupling is effected by a draw pin 14 which projects through an opening 16 located in a pin guide 18 connected to the front of the mine car 10, the opening 13 in the connecting link 12, and an opening 20 located in a deck 22 connected to the mine car 10. The deck 22 can be formed of wood reinforced with a steel bumper overlay 24 as shown in FIG. 1.

The draw pin 14 is held in place by a lift linkage which is generally designated by reference numeral 26 and includes an upper element 28 and lower element 30 which are connected together by any suitable means at a pivot point 32. The lower end of the lower element 30 is pivotally connected to the draw pin 14 by any suitable means.

Figure 2:
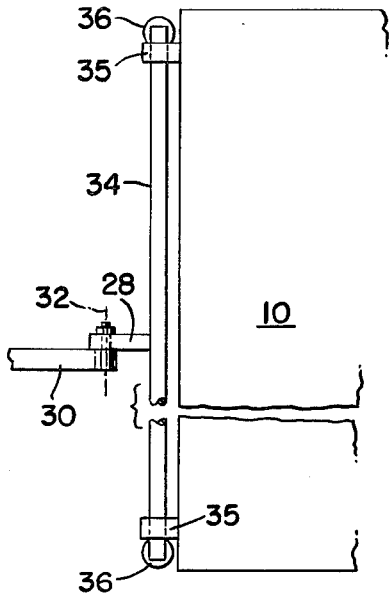
FIG. 2 is a top plan view showing the connection between the draw pin linkage and the front of a mine car.

As shown in FIGS. 1 and 2 the upper end of the upper element 28 is rigidly connected to a shaft 34 which in turn is rotatably mounted on the front of the mine car 10 by means of mounting brackets 35. A drop handle 36 is connected at each end of the shaft 34 so that the upper element can be rotated by manually rotating the handles 36.

As shown in FIG. 1, when the draw pin 14 is in its lowermost position and the two mine cars are coupled together, the pivot point 32 of the lift linkage 26 is below the line which runs between the points of connection of the linkage 26, e.g. the shaft 34, on the one hand, and the pin 14, on the other hand, to provide a gravity held overcenter lock to prevent the draw pin 14 from bouncing upward and accidentally uncoupling the mine cars.

Figure 3:
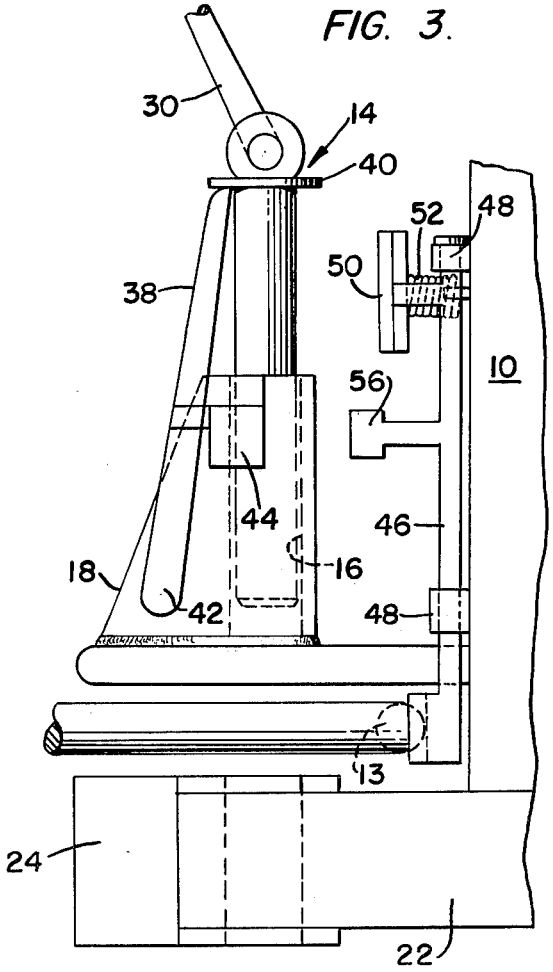
FIG. 3 is a view similar to that of FIG. 1 showing the draw pin after it has been lifted out of engagement with the connecting link of the other mine car.

In order to remove the draw pin 14 from the opening 13 in the connecting link 12, one of the drop handles 36 is rotated outwardly away from the front of the mine car 10 which causes the upper member 28 to rotate clockwise in FIG. 1 and pull the lower member 30 and draw pin 14 upwardly to the position shown in FIG. 3. As this happens, a first interposer 38 which is pivotally mounted by any suitable means on the pin guide 18 and normally rests against an upper shoulder 40 of the draw pin 14 (as shown in FIG. 1) rotates toward the draw pin 14 about a pivot point 42 to the position shown in FIG. 3. This rotation is caused by a counterweight 44 connected as shown in FIGS. 1 and 3 so that as the draw pin 14 reaches the position shown in FIG. 3, the upper end of the first interposer 38 will move beneath the shoulder 40 and prevent the draw pin 14 from moving downward.

Figure 4:
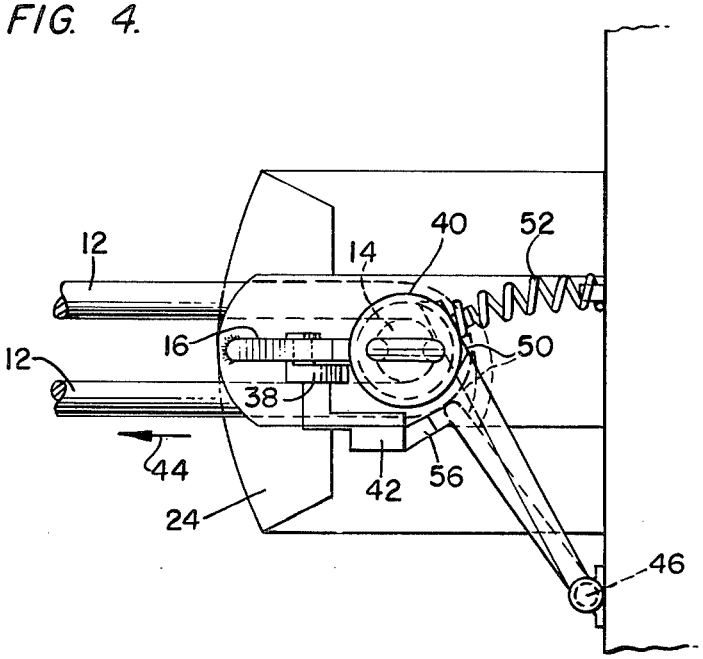
FIG. 4 is a top plan view which shows the arrangement of the interposer elements of the mine car coupling when the draw pin is in the position shown in FIG. 5 and the connecting link of the other mine car is moving out of engagement with the first mine car.

As the mine cars are pulled apart and the connecting link 12 is moved outwardly away from the mine car 10, as shown in FIG. 4 and indicated by the arrow 44, a second interposer 46 will automatically move under the shoulder 40 of the draw pin 14 as will be explained below. The second interposer 46 is rotatably mounted on the front of the mine car 10 by means of mounting brackets 48 and, as best shown in FIGS. 3 and 4, includes an upper arm 50 which is movable into and out of the path of movement of the shoulder 40.

A spring 52 urges the upper arm 50 outwardly against the pin 14, but when the connecting link 12 is in the position shown in FIGS. 1 and 2 it will contact a lower arm 54 of the second interposer causing the spring 52 to be compressed and the upper arm to be moved out of the path of the shoulder 40. Instead of a spring, a suitable magnet could be used to urge the upper arm 50 outwardly.

Figure 5:
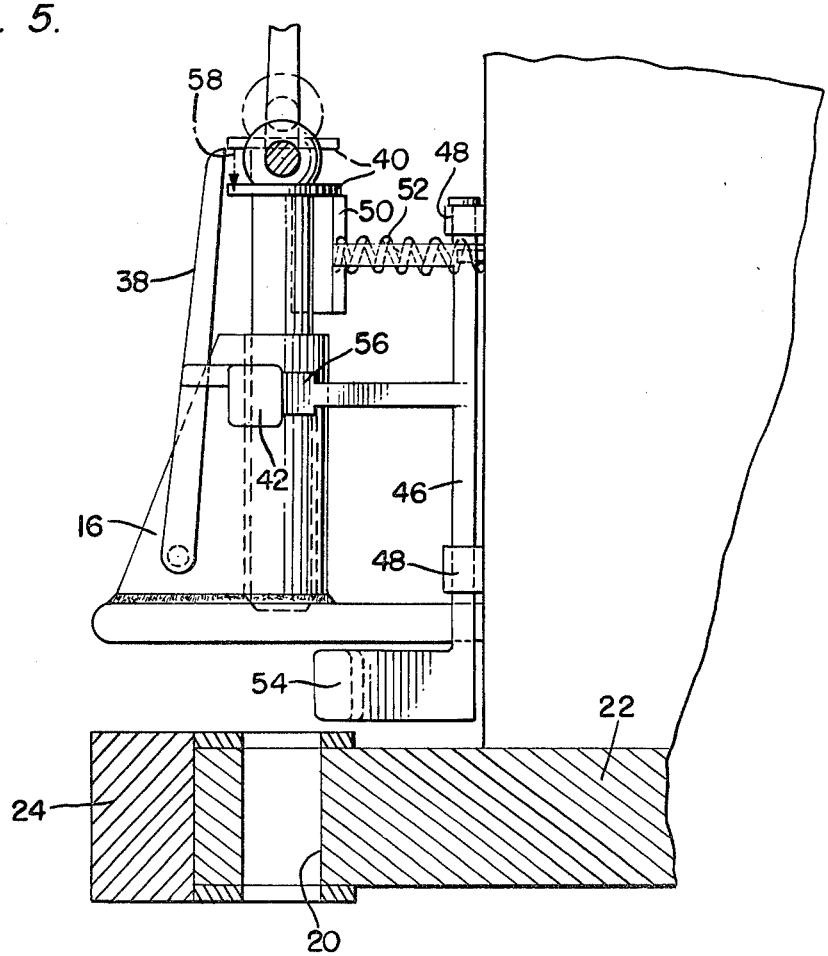
FIG. 5 is a view similar to that of FIGS. 1 and 3 which shows the mine car coupling when the connecting link of the other car has been withdrawn.

When the connecting link 12 is withdrawn as shown in FIG. 4 the spring 52 will urge the upper arm 50 and lower arm 54 outwardly away from the front of the mine car 10 so that the upper arm will move beneath the shoulder 40 of the pin 14 as shown in FIG. 5.

At the same time a contact member 56, also included as part of the second interposer 46, will engage the counterweight 44 of the first interposer 38 and push the latter out of engagement with the shoulder 40 so that the draw pin 14 will drop a short distance shown by the dotted lines and arrow 58 in FIG. 5 and rest on the top edge of the upper arm 50. This completes the sequence of movement of the coupling device as the two mine cars move apart from each other.

In order to couple the cars together again, the connecting link 12 will be reinserted into the position shown in FIG. 1 at which time the front edge of the connecting link 12 will engage the lower arm 54, causing the second interposer to rotate and the upper arm 50 to move out of engagement with the shoulder 40. This causes the draw pin 14 to automatically drop in place and couple the cars together.

In this way, a dual coupling mechanism is provided which will hold the draw pin in a lower position when the cars are coupled and in an upper position when the cars are either uncoupled or in the process of being uncoupled and provide a safety mechanism for preventing the pin from falling inadvertantly. The coupling also provides for automatically lowering of the pin to couple the cars when they are moved together.

It should be understood that modifications and improvements can be made to the invention by one with ordinary skill in the art and that all such modifications and improvements are intended to fall within the scope of the invention as defined in the claims appended below.

I claim:

1. A safety mechanism for a mine car coupling of the type which comprises a draw pin, a pin guide connected to a first mine car with an essentially vertical opening therein for receiving the draw pin, a space beneath the pin guide for receiving a link connected to a second mine car, the link having an opening therein, the draw pin including an upper shoulder which will engage an upper surface of the pin guide and hold the draw pin in its lowered position for insertion through the link opening to couple the cars together, the safety mechanism comprising a first interposer pivotally connected to the first car at a point below the upper shoulder of the draw pin and projecting above the upper shoulder a predetermined distance when the pin is in its lowered position, means for urging the first interposer toward the upper shoulder so that when the draw pin is in its lowered position the first interposer will engage an outer surface of the upper shoulder, and when the draw pin is raised the first interposer will engage an undersurface of the shoulder for preventing the pin from moving toward its lowered position, a second interposer connected to the first mine car and movable between inner and outer positions, means for urging the second interposer toward the outer position, the second interposer including a first arm positioned to engage the link connected to the second mine car when the link is in position to receive the draw pin for retaining the second interposer in the inner position, the second interposer being moved toward the outer position by the urging means when the link disengages from the first arm, a second arm positioned to engage an undersurface portion of the upper shoulder of the draw pin when the second interposer is in the outer position, and contact means for engaging a portion of the first interposer and moving it out of engagement with the undersurface of the upper shoulder when the second interposer moves to the outer position, the second arm being located below the portion of the first interposer which engages the shoulder undersurface so that when the first interposer is moved out of engagement with its corresponding undersurface portion the second arm will engage its corresponding undersurface portion and hold the pin in its raised position, the second arm moving out of engagement with its undersurface portion and allowing the pin to move to its lowered position when the link engages the first arm and causes the second interposer to move toward its inner position.

2. The safety mechanism in claim 1, wherein the first interposer is pivotally mounted on the pin guide.

3. The safety mechanism in claim 1, wherein the urging means for the first interposer includes a counterweight connected thereto.

4. The safety mechanism in claim 3, wherein the counterweight is the portion of the first interposer engaged by the contact means.

5. The safety mechanism in claim 1, wherein the second interposer is rotatably mounted on one end of the first mine car.

6. The safety mechanism in claim 1, wherein the urging means for the second interposer includes a compression spring connected between the second arm and the first mine car.

7. The safety mechanism in claim 1 and further including means for retaining the draw pin in its lowered position and manually operated means for raising the draw pin.

8. The safety mechanism in claim 7, wherein retaining means includes a gravity held overcenter linkage connected at one end to the draw pin and at the other end to the raising means.

9. The safety mechanism in claim 8, wherein the raising means includes a shaft rotatably mounted on the first mine car and a handle connected to at least one end of the shaft for rotating the shaft and raising the draw pin through the linkage.

* * * * *